US006085845A

United States Patent [19]

Patel et al.

[11] Patent Number: 6,085,845

[45] Date of Patent: Jul. 11, 2000

[54] SURFACE CONTROLLED FORMATION ISOLATION VALVE ADAPTED FOR DEPLOYMENT OF A DESIRED LENGTH OF A TOOL STRING IN A WELLBORE

[75] Inventors: Dinesh R. Patel, Sugarland; Gary L. Rytlewski, League City, both of Tex.

[73] Assignee: Schlumberger Technology Corporation, Sugar Land, Tex.

[21] Appl. No.: 08/762,762

[22] Filed: Dec. 10, 1996

[51] Int. Cl.[7] ..... E21B 34/12

[52] U.S. Cl. ..... 166/373; 166/386; 166/332.3; 251/54

[58] Field of Search ..... 166/373, 375, 166/386, 332.3, 334.2, 334.3, 332.6, 320, 321; 251/48, 54

[56] References Cited

U.S. PATENT DOCUMENTS

| | | | |
|---|---|---|---|
| 3,435,897 | 4/1969 | Barrington | 251/54 X |
| 3,509,913 | 5/1970 | Lewis . | |
| 3,675,718 | 7/1972 | Kanady . | |
| 4,113,018 | 9/1978 | Barrington et al. | 251/54 X |
| 4,197,879 | 4/1980 | Young . | |
| 4,420,045 | 12/1983 | McMahan | 166/334.2 |
| 4,706,933 | 11/1987 | Sukup et al. | 251/54 |
| 4,753,292 | 6/1988 | Ringgenberg et al. | 166/321 X |
| 4,979,569 | 12/1990 | Anyan et al. . | |
| 5,058,673 | 10/1991 | Muller et al. . | |
| 5,101,907 | 4/1992 | Schultz et al. | 166/386 |

FOREIGN PATENT DOCUMENTS

| | | |
|---|---|---|
| A-0679796 | 4/1995 | European Pat. Off. . |
| 2313610 | 3/1997 | United Kingdom . |
| 2312909 | 11/1997 | United Kingdom . |

OTHER PUBLICATIONS

Brochure entitled "Baker Oil Tools Safety Systems—The Leader in Completion Technology.", Dec., 1992.

Brochure entitled "Baker Oil Tools Flow Control Systems—People and Products Providing Solutions for Completions, Workovers and Fishing", Mar., 1994.

*Primary Examiner*—William P Neuder

*Attorney, Agent, or Firm*—Gordon G. Waggett; John J. Ryberg; John Bouchard

[57] ABSTRACT

A method and apparatus is disclosed for building a tool string uphole of any desired length prior to lowering that tool string downhole into a wellbore for the purpose of performing wellbore operations downhole during a single trip into the wellbore. The apparatus includes a valve disposed between an upper section and a lower section of the wellbore and adapted to open and to close, the upper section of the wellbore being isolated from the lower section of the wellbore when the valve is closed. The tool string of any desired length is built in the upper section of the wellbore when the valve is closed and the upper section of the wellbore is isolated from the lower section of the wellbore. The apparatus also includes a mandrel and piston, the valve being initially disposed in an open position and adapted to be changed from the open position to a closed position when the mandrel is shifted from one position to another position. An upper chamber communicates with a gas reservoir and a valve manifold at the surface. The manifold includes a slow bleed valve and a fast bleed valve disposed at the wellbore surface. A gas metering orifice separates the upper chamber from a lower chamber. The mandrel is shifted in one direction and the valve changes position when a gas is delivered from the surface of the wellbore to the upper chamber thereby moving the piston and the mandrel, the mandrel shifting in an opposite direction and the valve changing position again when the gas in the upper chamber leaks from the upper chamber to the fast bleed valve at the surface. The mandrel shifts in the one direction and the valve changes position again when the gas from the surface is delivered to the upper chamber. However, the mandrel does not shift in the opposite direction and the valve does not change position again when the gas in the upper chamber leaks from the upper chamber to the slow bleed valve at the surface.

14 Claims, 2 Drawing Sheets

SURFACE CONTROLLED FORMATION ISOLATION VALVE ADAPTED FOR DEPLOYMENT OF A DESIRED LENGTH OF A TOOL STRING IN A WELLBORE

BACKGROUND OF THE INVENTION

The subject matter of the present invention relates to a method and apparatus for isolating a first section of a wellbore from a second section of the wellbore, the second section being disposed below the first section in the wellbore and adjacent a formation, in order that a wellbore tool string of any desired length may be made up in the first section prior to opening a ball valve and lowering the tool string downhole into the second section of the wellbore for performing one or more wellbore operations downhole in the second section.

A prior pending application, filed by the same applicant (Dinesh R. Patel) and owned by the same assignee as that of the present invention, relates to the same field of the invention as that recited above. The prior pending application corresponds to attorney docket number 22.1185, was filed on May 10, 1996, and is entitled "Formation Isolation Valve Adapted for Building a Tool String of Any Desired Length Prior to Lowering the Tool String Downhole for Performing a Wellbore Operation". In the prior pending application to Patel, a valve is disposed in a tubing string in a similar manner as shown in FIG. 1 of the drawings of this application. The valve is responsive to the running of a shifting tool through a full bore of the valve for opening and closing the valve. When the valve is closed in response to the running of the shifting tool through the valve, a tool string of any desired length is built in a first section of the wellbore above the valve. When the tool string is built, the valve is opened in response to a pressure applied to a wellbore fluid in the first section, and the tool string is run downhole through the open valve for performing wellbore operations.

When performing wellbore operations downhole, it is necessary to first make up a tool string at the surface of the wellbore prior to lowering that tool string downhole for performing the wellbore operations. In the past, the length of the tool string was limited by the maximum height of surface equipment and a longer tool string length was often desired. Therefore, when the tool string performed the wellbore operations downhole, that tool string was raised uphole and another, second tool string was made up at the surface of the wellbore. The second tool string was lowered downhole for performing additional wellbore operations. However, it is time consuming and expensive to continually make up additional tool strings at the wellbore surface, following the performance of the initial wellbore operation by the first tool string, and sequentially lower those additional tool strings downhole for performing additional wellbore operations. It would be desirable to make up one tool string having the desired length at the wellbore surface and to lower that desired tool string downhole for performing a wellbore operation during one trip into the wellbore. For example, when the tool strings include perforating guns, in the past, it was necessary to implement the following perforating procedure when perforating long length intervals of a wellbore: perforate the long length interval during multiple trips into the wellbore by making up, at the wellbore surface, a first perforating gun having a limited first length, lowering the first perforating gun downhole, perforating a formation penetrated by the wellbore, raising the first perforating gun uphole (or dropping that perforating gun to the bottom of the wellbore), making up a second perforating gun having another second limited length at the wellbore surface, lowering the second perforating gun downhole, perforating another section of the formation, raising the second perforating gun uphole (or dropping it to a bottom of the wellbore), etc. The above referenced perforating procedure is time consuming and costly.

As a result, it became necessary to design a method and apparatus for creating a tool string, of any desired length, uphole at the surface of the wellbore, so that the tool string may be lowered downhole and wellbore operations performed downhole during only one trip into the wellbore.

U.S. Pat. No. 5,509,481 to Huber et al discussed one method for perforating long length intervals of a formation during a single run into the wellbore. The Huber apparatus disclosed an automatic release apparatus which would disconnect one part of a long gun string from a second part of the gun string just before the perforating guns of that gun string would detonate.

Another prior pending application also discloses a method and apparatus for making up, at the wellbore surface, a tool string of any desired length prior to lowering that tool string downhole for performing a wellbore operation in the wellbore during one trip into the wellbore. In a prior pending application entitled "Completions Insertion and Retrieval Under Pressure (CIRP) Apparatus including the Snaplock Connector", having a Ser. No. 08/638,001 and filed on Apr. 25, 1996 and corresponding to attorney docket number 22.1183 and corresponding to a prior filed provisional application number 60/010,500 filed Jan. 24, 1996 (hereinafter, the "CIRP application"), a tool string of any desired length is built uphole prior to lowering that tool string downhole by first holding a first tool, having a first and a second section of a snaplock connector connected thereto, in a deployment BOP or snaplock operator while suspending a second tool, also having a third section of the snaplock connector connected thereto, by wireline in a lubricator. The second tool is lowered down through the lubricator and through a master valve by operating a winch until the third section of the snaplock connector on the second tool connects to the second section of the snaplock connector on the first tool thereby forming a first tool string having a length which corresponds to the first tool and the second tool. The hold by the deployment BOP is released from the first tool, the first tool string is lowered, and the deployment BOP grips the second tool. The second tool also includes another first, second, and third section of a snaplock connector connected to its opposite side, the third section (called a deployment stinger) being connected to the wireline. The deployment stinger is raised uphole by operating the winch, and it is replaced by a third tool, such as a firing head, which also includes a third section of a snaplock connector. The third tool suspends by the wireline in the lubricator and it is lowered downhole and attached to the second tool being held by the deployment BOP. The hold by the deployment BOP on the second tool is released, and a resultant tool string of the desired length, consisting of the first tool, the second tool, and the third tool, is lowered downhole for the purpose of performing wellbore operations downhole during one trip into the wellbore.

However, another alternate apparatus, and corresponding method, is needed for isolating the formation downhole by means of closing a valve so that wellhead pressure can be bled off for building a long tool string uphole of any desired length and lowering that tool string downhole without a need for snubbing under wellhead pressure for the purpose of performing wellbore operations downhole during a single trip into the wellbore.

SUMMARY OF THE INVENTION

Accordingly, it is a primary object of the present invention to provide another alternate method and apparatus for building a tool string uphole of any desired length prior to lowering that tool string downhole for the purpose of performing wellbore operations downhole during a single trip into the wellbore.

It is a further object of the present invention to provide another alternate method and apparatus for building a tool string uphole of any desired length prior to lowering that tool string downhole for the purpose of performing wellbore operations downhole during a single trip into the wellbore, the alternate apparatus including a valve disposed between an upper section and a lower section of the wellbore and adapted to open and to close, the upper section of the wellbore being isolated from the lower section of the wellbore when the valve is closed, the tool string of any desired length being built in the upper section of the wellbore when the valve is closed and the upper section of the wellbore is isolated from the lower section of the wellbore.

It is a further object of the present invention to provide another alternate method and apparatus for building a tool string uphole of any desired length prior to lowering that tool string downhole into a wellbore for the purpose of performing wellbore operations downhole during a single trip into the wellbore, the alternate apparatus including a valve disposed between an upper section and a lower section of the wellbore and adapted to open and to close, the upper section of the wellbore being isolated from the lower section of the wellbore when the valve is closed, the tool string of any desired length being built in the upper section of the wellbore when the valve is closed and the upper section of the wellbore is isolated from the lower section of the wellbore, the alterate apparatus further including a mandrel and piston, the valve, such as a ball valve, initially disposed in an open position adapted to be changed from the open position to a closed position when the mandrel is shifted from one position to another position, an upper chamber communicating with a gas reservoir and a valve manifold including a slow bleed valve and a fast bleed valve disposed at the wellbore surface, a lower chamber, and a gas metering orifice separating the upper chamber from the lower chamber, the mandrel being shifted in one direction and the valve changing position when a gas is delivered from the surface of the wellbore to the upper chamber thereby moving the piston and the mandrel, the mandrel shifting in an opposite direction and the valve changing position again when the gas in the upper chamber leaks from the upper chamber to the fast bleed valve at the surface, the mandrel shifting in the one direction and the valve changing position again when the gas from the surface is delivered to the upper chamber, and the mandrel not shifting in the opposite direction and the valve not changing position again when the gas in the upper chamber leaks from the upper chamber to the slow bleed valve at the surface.

In accordance with these and other objects of the present invention, an apparatus adapted to be disposed in a wellbore allows an operator at the wellbore surface to build a tool string uphole of any desired length prior to lowering that tool string downhole into a wellbore for the purpose of performing wellbore operations during a single trip into the wellbore. The apparatus includes a valve disposed between an upper section and a lower section of the wellbore which is adapted to open and to close. The upper section of the wellbore is isolated from the lower section of the wellbore when the valve is closed. The tool string of any desired length is built in the upper section of the wellbore when the valve is closed and the upper section of the wellbore is isolated from the lower section of the wellbore. The apparatus further includes a mandrel and a piston, the valve, such as a ball valve, which is initially disposed in an open position and is adapted to be changed from the open position to a closed position when the mandrel is shifted from one position to another position, an upper chamber communicating with a gas reservoir and a valve manifold (including a slow bleed valve and a fast bleed valve) disposed at the wellbore surface, a lower chamber, and a gas metering orifice separating the upper chamber from the lower chamber. The mandrel is shifted in one direction and the valve changes position when a gas is delivered from the surface of the wellbore to the upper chamber thereby moving the piston and the mandrel. The mandrel shifts in an opposite direction and the valve changes position again when the gas in the upper chamber leaks from the upper chamber to the fast bleed valve at the surface. The mandrel shifts in the one direction and the valve changes position again when the gas from the surface is delivered to the upper chamber. However, the mandrel does not shift in the opposite direction and the valve does not change position again when the gas in the upper chamber leaks from the upper chamber to the slow bleed valve at the surface. The mandrel does not shift in the opposite direction because the flow rate at which the gas in the upper chamber flows through the slow bleed valve at the surface is less than the rate at which the gas in the lower chamber meters into the upper chamber via the gas metering orifice. Therefore, the gas pressure in the upper and lower chambers remain approximately equal despite the fact that the gas in the upper chamber flows upwardly through the slow bleed valve at the surface. As a result, the mandrel and piston fail to shift in either direction.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figures 1, 2:
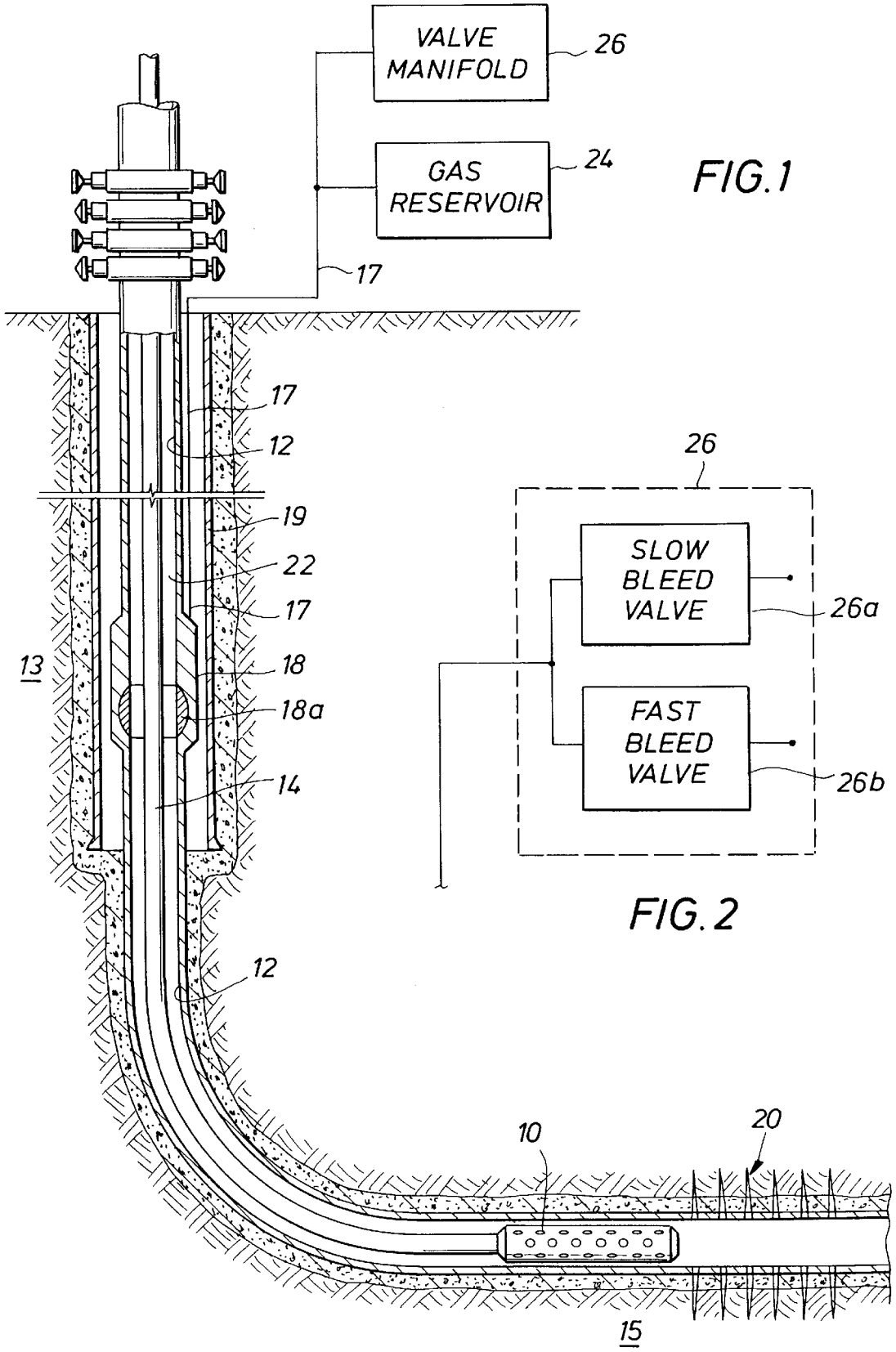
FIG. 1 illustrates a tubing string including a valve in accordance with the present invention and a coiled tubing or wireline conveyed perforating gun runnning through the full bore of the tubing string and through the valve and running downhole into a deviated wellbore, a gas reservoir and a valve manifold being disposed at a surface of the wellbore.
FIG. 2 illustrates a more detailed construction of the valve manifold of FIG. 1.

Referring to FIG. 1, a tubing string 12 having a full bore is disposed in a partially deviated wellbore consisting of a vertical wellbore 13 and a deviated wellbore 15. The tubing string 12 includes a valve 18 which is disposed in the vertical wellbore 13 portion of the partially deviated wellbore. The valve 18 includes a ball valve 18*a* which is rotatable between a closed position, for closing off the full bore of the tubing string 12 thereby preventing fluid communication within the tubing string 12 between the vertical wellbore 13 and the deviated wellbore 15, and an open position for opening and allowing fluid communication within the tubing string 12 between the vertical wellbore 13 and the deviated wellbore 15. In FIG. 1, a tubing 14, such as coiled tubing 14, having a perforating gun 10 suspending from the lower end of the coiled tubing 14, is disposed within the tubing string 12 and within both the vertical wellbore 13 and the deviated wellbore 15 of the partially deviated wellbore when the ball valve 18*a* is disposed in the open position. When the coiled tubing 14 is disposed within the tubing string 12 as shown in FIG. 1, an annulus space 22 located above the ball valve 18*a* is defined between the coiled tubing 14 and the tubing string 12. However, when the coiled tubing 14 is not disposed within the tubing sring 12 as shown in FIG. 1, a full bore space 22 is located above the ball valve 18*a* within the tubing string 12. As mentioned later, when the ball valve 18*a* is closed, this full bore space 22 can be used to build a new tool string uphole of any desired length. In the vertical wellbore 13 of FIG. 1, the tubing string 12 does not form part of the casing of the wellbore; however, in the deviated wellbore 15 of FIG. 1, the tubing string 12 forms the casing in the deviated wellbore.

In FIG. 1, the valve 18, which is situated downhole, is connected to a gas reservoir 24 (a nitrogen bottle 24) and a valve manifold 26, each of which are separately situated at the surface of the wellbore. A gas is stored in the gas reservoir 24, the gas flowing between the gas reservoir 24/valve manifold 26 at the wellbore surface and the valve 18 located downhole in the wellbore via a flowline 17. The flowline 17 is a one-quarter inch (¼") pipe situated between the tubing string 12 and a casing 19 in the vertical wellbore 13 and connected between a control line 18*c* of the valve 18 (see FIG. 3) and the gas reservoir 24/valve manifold 26 situated at the surface of the wellbore. The gas reservoir 24 is really a nitrogen bottle which stores a gas, such as nitrogen, and the valve manifold 26 includes a pair of bleed valves (a slow bleed valve and a fast bleed valve) which are more particularly shown in FIG. 2. The gas in the gas reservoir 24 uphole communicates with the valve 18 downhole. When the gas in the gas reservoir 24 has been communicated to the valve 18, that same gas in the valve 18 can then be re-communicated back to the bleed valves of the valve manifold 26, a process which will be described in more detail below in this specification.

Referring to FIG. 2, the valve manifold 26 includes a slow bleed valve 26*a* and a fast bleed valve 26*b*. As the names imply, the slow bleed valve 26 will allow a gas to pass (bleed) very slowly therethrough, whereas the fast bleed valve 26*b* will allow a gas to pass (bleed) very rapidly therethrough. The function of these bleed valves 26*a*, 26*b* will be set forth below in the functional description of the operation of the present invention.

In operation, referring to FIG. 1, the ball valve 18*a* is open and the perforating gun 10 with associated coiled tubing 14 is situated in the wellbore as shown in FIG. 1, the perforating gun 10 perforating the formation penetrated by the deviated wellbore 15 thereby forming a plurality of perforations 20 in the deviated wellbore 15. When the perforating gun 10 has perforated the deviated wellbore 15, the coiled tubing 14 and the perforating gun 10 are raised uphole until the perforating gun 10 passes through the ball valve 18*a* of the valve 18, at which point, the perforating gun 10 and associated coiled tubing 14 are located above the valve 18 within the tubing string 12 in the vertical wellbore 13. The ball valve 18*a* is then closed. When the ball valve 18*a* is closed, the perforating gun 10 is raised uphole to a surface of the wellbore, leaving empty the full bore space 22 which is located above the closed ball valve 18*a* within the tubing string 12. A new tool string of any desired length (the length of the new tool string being limited only by the distance between the ball valve 18*a* and the wellbore surface) may then be built within the full bore space 22. When the new tool string is built within the full bore space 22, the ball valve 18*a* is reopened, and the new tool string is lowered downhole for the purpose of performing other wellbore operations downhole.

Figure 3:
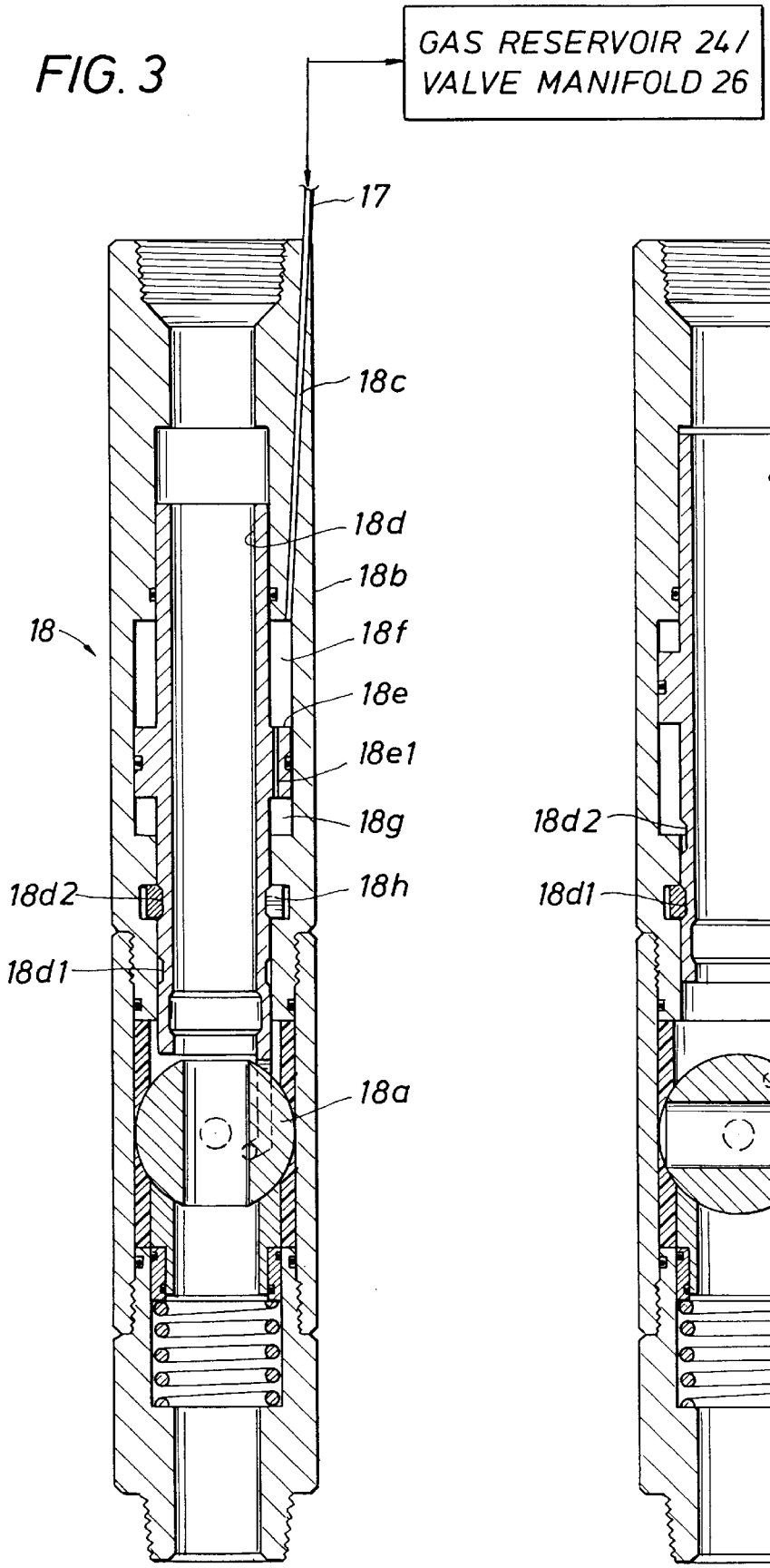
FIGS. 3 and 4 illustrate a more detailed construction of the valve of FIG. 1 in accordance with the present invention.
Figure 4:
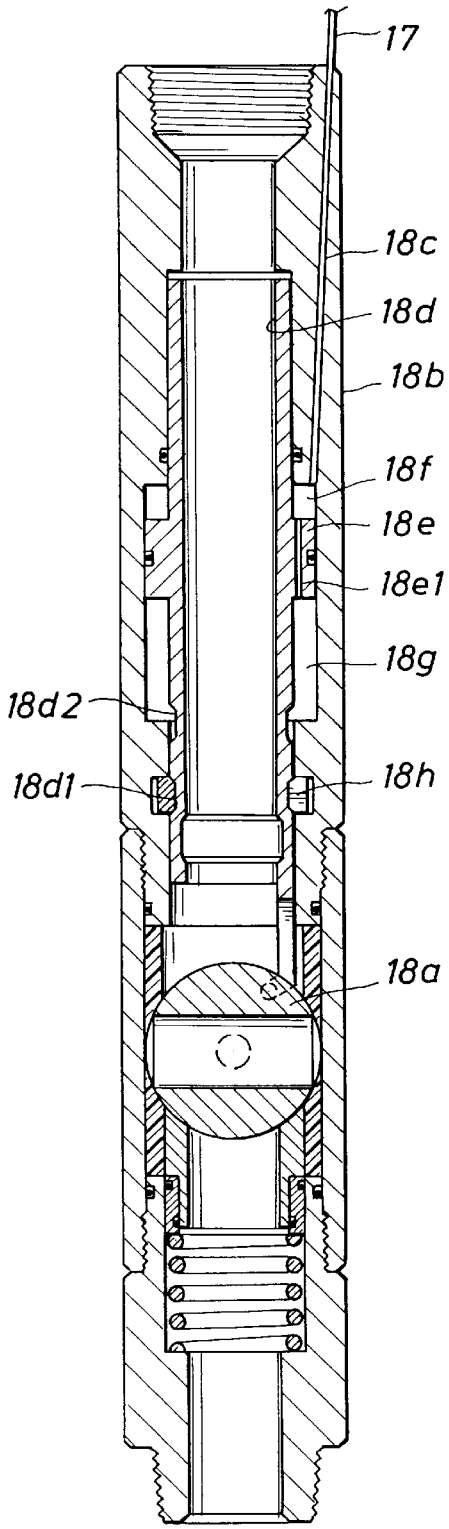

Referring to FIGS. 3 and 4, a detailed construction of the valve 18 of the present invention is illustrated.

In FIGS. 3 and 4, the valve 18 of the present invention, adapted for deploying a desired length of a tool string in a wellbore, includes an outer housing 18*b*. The outer housing 18*b* further includes an open port 18*c*, otherwise known as a control line 18*c*, which is connected to the flowline 17, the one-quarter inch pipe 17 that is connected to the gas reservoir 24 and the valve manifold 26 at the surface of the wellbore. The gas in the gas reservoir 24 can communicate with the control line 18*c* of the valve 18 via the flowline pipe 17, and the gas in the valve 18 can communicate with the bleed valves 26*a*, 26*b* of the valve manifold 26 via the control line 18*c* of the valve 18 and the flowline pipe 17.

The valve 18 of FIGS. 3 and 4 further include a mandrel 18*d* connected to the ball valve 18*a* and enclosed by the outer housing 18*b*. The mandrel 18*d* is further connected to a piston 18*e*, and the piston 18*e* separates an upper gas chamber 18*f* from a lower gas chamber 18*g*. The upper gas chamber 18*f* is defined by the mandrel 18*d*, an upper part of the piston 18*e* and the outer housing 18*b*, whereas the lower gas chamber 18*g* is defined by the mandrel 18*d*, a lower part of the piston 18*e*, and the outer housing 18*b*. The piston 18*e* includes a gas metering orifice 18*e*1 disposed through the axial center of the piston 18*e*. The gas metering orifice 18*e*1 allows a gas, such as nitrogen, from the gas reservoir 24, to be metered slowly between the upper gas chamber 18*f* and the lower gas chamber 18*g*, for reasons which will be described later in this specification. A spring biased ratchet 18*h* is biased inwardly by a spring, as shown in FIGS. 3 and 4, the ratchet 18*h* adapted to be received in one of two detents 18*d*1 and 18*d*2 in the mandrel 18*d*, the detents 18*d*1, 18*d*2 each being a groove which is carved into the mandrel 18*d* and which is adapted to receive the ratchet 18*h*.

A functional description of the operation of the surface controlled formation isolation valve of the present invention, adapted for deploying a desired length of a tool string in a wellbore, will be set forth in the following paragraphs with reference to FIGS. 1 through 4 of the drawings.

The perforating gun 10 of FIG. 1 perforates the formation 15 and produces a plurality of perforations 20 in the formation 15. An operator at the wellbore surface of FIG. 1 raises the coiled tubing 14 uphole. Since the perforating gun 10 is connected to the coiled tubing 14, the perforating gun 10 also is raised uphole in FIG. 1. Since the ball valve 18*a* of the valve 18 is open, the perforating gun 10 will pass through the full bore center of the valve 18. When the perforating gun 10 is removed from the full bore space 22 of the vertical wellbore 13, the valve 18 must now be closed so that a tool string of desired length may be built inside the full bore space 22 which is situated above the closed ball valve 18*a* in the vertical wellbore 13.

In order to close the ball valve 18*a*, referring to FIGS. 1, 2, and 3, assume that the gas pressure within the upper gas chamber 18*f* is equal to the gas pressure within the lower gas chamber 18*g*. The gas present in the upper gas chamber 18*f* is allowed to flow through the control line 18*c*, through the flowline pipe 17, and into the valve manifold 26 of FIG. 1 for the purpose of closing the ball valve 18*a*. In the valve manifold 26, the gas flows into the fast bleed valve 26*b* of FIG. 2. As a result, the gas will flow from the upper gas chamber 18*f*, through flowline 17, and through the fast bleed valve 26*b* at a rate which is faster than the rate at which the gas in the lower gas chamber 18*g* can meter through the gas metering orifice 18*e*1 into the upper gas chamber 18*f*. Therefore, the gas pressure inside the upper gas chamber 18*f* will be less than the gas pressure inside the lower gas chamber 18*g* and, as a result, the piston 18*e* and the mandrel 18*d* move upwardly in FIG. 3. The ball valve 18*a* closes. Eventually, the gas pressure inside the upper gas chamber 18*f* and the lower gas chamber 18*g* falls to a value which is approximately equal to zero. The closed ball valve 18*a* is shown in FIG. 4.

With the ball valve 18*a* closed, another, new tool string of desired length is built inside the full bore space 22 located above the closed ball valve 18*a* in FIG. 1.

When the new tool string is built in the full bore space 22, the ball valve 18*a* must now be re-opened so that the new tool string can be lowered downhole, from its current location in the full bore space 22, for the purpose of performing a new wellbore operation downhole.

The ball valve 18*a* is re-opened in the following manner: referring to FIGS. 1 and 4, a gas, such as Nitrogen, from the gas reservoir 24, is forced to flow from the reservoir 24, through the flowline pipe 17, through the control line 18*c* in FIG. 3, and into the upper gas chamber 18*f*. The gas is exerted against the piston 18*e*, and it begins to meter slowly through the gas metering orifice 18*e*1 into the lower gas chamber 18*g*. However, since there is no gas within the lower gas chamber 18*g*, the piston 18*e* moves downwardly in FIG. 4 which, in turn, moves the mandrel 18*d* downwardly and which re-opens the ball valve 18*a*, as shown in FIG. 3. Eventually, the gas in the upper gas chamber 18*f* flows through the metering orifice 18*e*1 into the lower gas chamber 18*g*. As a result, when the ball valve 18*a* is re-opened, the gas pressure in the upper gas chamber 18*f* equals the gas pressure in the lower gas chamber 18*g*.

At this point, now that the ball valve 18*a* is reopened, the new tool string can be lowered downhole, from its current location in the full bore space 22, and through the ball valve 18*a*, for the ultimate purpose of performing a new wellbore operation downhole.

In FIGS. 1, 2 and 3, the gas in the lower gas chamber 18*g* of FIG. 3 can flow into the upper gas chamber 18*f*, and the gas in the upper gas chamber 18*f* in FIG. 3 can flow through the flow line pipe 17 and into valve manifold 26 without reclosing the ball valve 18*a* as previously recited. To accomplish this without reclosing the ball valve 18*a*, in FIG. 3, the gas in the upper gas chamber 18*f* will flow into the flowline pipe 17, and into the slow bleed valve 26*a* of the valve manifold 26 of FIG. 2 (the gas does not flow into the fast bleed valve 26*b*). As a result, since the gas flows into the slow bleed valve 26*a*, the rate at which the gas flows from the upper gas chamber 18*f* and through the slow bleed valve 26*a* is lower than the rate at which the gas in the lower gas chamber 18*g* flows through the gas metering orifice 18*e*1 and into the upper gas chamber 18*f*.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An apparatus for building a desired length of tool string for downhole operations in a wellbore, comprising:

a valve disposed between an upper section and a lower section of the wellbore, the valve adapted to move between a closed position to allow the tool string to be built in the upper section of the wellbore and an open position to allow the tool string to be lowered from the upper section of the wellbore through the valve to the lower section of the wellbore; and a controller for opening and closing the valve comprising:

a valve manifold;

a gas reservoir; and a flowline interconnecting the valve manifold and the gas reservoir to the valve.

2. The apparatus of claim 1, wherein said gas reservoir includes a gas, said valve manifold including a slow bleed valve and a fast bleed valve, said gas in said gas reservoir adapted to flow from said gas reservoir through said flowline and into said valve.

3. The apparatus of claim 2, wherein said valve comprises an outer housing, a mandrel enclosed by said outer housing and defining a full bore within said valve, and a piston attached to an outer side of said mandrel, said piston including a metering orifice disposed longitudinally therethrough, said mandrel and said piston being longitudinally movable within said housing, said mandrel and said piston defining an upper chamber within said housing disposed between said mandrel and said housing and one side of said piston, said upper chamber communicating with said flowline, said flowline communicating with said slow bleed valve and said fast bleed valve of said further apparatus and said gas reservoir of said further apparatus, said mandrel and said piston defining a lower chamber within said housing disposed between said mandrel and said housing and the other side of said piston.

4. The apparatus of claim 3, wherein said valve further comprises closure means attached to said mandrel for opening said full bore of said valve when said mandrel is disposed in one longitudinal position within said valve and closing said full bore of said valve when said mandrel is disposed in another longitudinal position within said valve.

5. The apparatus of claim 4, wherein said gas in said gas reservoir flows through said flowing and into said upper chamber of said valve, a pressure of said gas in said upper chamber exerting against said one side of said piston, said gas in said upper chamber metering through said metering orifice into said lower chamber and said mandrel moving longitudinally in one direction when said pressure of said gas is exerted against said one side of said piston, said closure means closing said full bore of said valve when said mandrel moves in said one direction, said tool string adapted to be built in said upper section when said closure means closes said full bore of said valve.

6. The apparatus of claim 5, wherein said gas in said lower chamber exerts a pressure against the other side of said piston, said gas metering from said lower chamber through said metering orifice and into said upper chamber, said mandrel moving in a direction opposite to said one direction, and said gas flowing from said upper chamber through said flowline and through said fast bleed valve when said fast bleed valve is connected to said flowline, said closure means reopens said full bore of said valve when said mandrel moves in said direction opposite to said one direction.

7. The apparatus of claim 6, wherein said tool string in said upper section is adapted to move downhole from said upper section through the reopened closure means and into said lower section when said closure means reopens said full bore of said valve.

8. The apparatus of claim 7, wherein said gas in said gas reservoir flows through said flowline and into said upper chamber when said tool moved from said upper section of said wellbore through the reopened closure means and into said lower section of said wellbore, said gas in said upper chamber metering from said upper chamber through said metering orifice and into said lower chamber, said gas in said upper chamber moving said mandrel in said one direction, said closure means reclosing said full bore of said valve when said mandrel moves in said one direction, said tool string in said lower section adapted to perform said wellbore operations downhole in said lower section of said wellbore when said closure means recloses said full bore of said valve.

9. A method of operating a valve in a wellbore, comprising the steps of:

moving a medium from a medium reservoir through a flowline and into an upper chamber of the valve;

exerting a pressure by the medium against a piston of the valve and moving a mandrel in one direction in response thereto;

metering the medium from the upper chamber through a metering orifice in the piston and into a lower chamber of the valve;

operating said valve by changing a state of the valve from a first state to a second state in response to the movement of said mandrel in said one direction;

exerting a pressure by the medium in said lower chamber against said piston;

metering said medium from said lower chamber through said metering orifice into said upper chamber through said flowline and through a fast bleed valve;

moving said mandrel in a direction opposite to said one direction; and operating said valve by changing said state of the valve from said second state to said first state in response to the movement of said mandrel in said direction opposite to said one direction.

10. A system adapted for use in connection with wellbore operations, comprising:

an outer housing;

a mandrel enclosed by the outer housing and movable longitudinally within said outer housing;

a piston on said mandrel and a metering orifice longitudinally disposed through said piston, said mandrel and said housing defining an upper chamber between the mandrel and the housing and one side of said piston, said mandrel and said housing defining a lower chamber between the mandrel and the housing and the other side of said piston; and a valve manifold and a flowline interconnecting said valve manifold to said upper chamber.

11. The system of claim 10, further comprising:

a reservoir, said flowline interconnecting said reservoir to said upper chamber.

12. The system of claim 11, wherein said valve manifold comprises a fast bleed valve and a slow bleed valve, said fast bleed valve adapted to be interconnected to said upper chamber via said flowline when said slow bleed valve is not interconnected to said upper chamber, said slow bleed valve adapted to be interconnected to said upper chamber via said flowline when said fast bleed valve is not interconnected to said upper chamber.

13. A method of building a tool string for performing downhole operations in the wellbore, comprising:

providing a valve between an upper section and a lower section of the wellbore;

closing the valve by moving a medium from the valve through a flowline into a fast bleed valve;

building the tool string in the upper section of the wellbore when the valve is closed;

opening the valve by moving the medium from a medium reservoir through the flowline into the valve;

moving the tool string from the upper section through the valve into the lower section of the wellbore when the valve is open; and operating the tool string to perform a downhole operation in the lower section of the wellbore.

14. The method of claim 13, further comprising maintaining the valve open by bleeding the medium from the valve through the flowline and through a slow bleed valve.

* * * * *